US007883370B2

(12) United States Patent
Ting et al.

(10) Patent No.: US 7,883,370 B2
(45) Date of Patent: Feb. 8, 2011

(54) SHIELDED CONNECTOR WITH ENLARGED BASE SUPPORTING CANTILEVERED BRACKETS EXTENDING FROM THE SHIELDED CONNECTOR

(75) Inventors: Chien-Jen Ting, Tu-Cheng (TW); Kuo-Chun Hsu, Tu-Cheng (TW); Tzu-Fan Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/778,142

(22) Filed: May 12, 2010

(65) Prior Publication Data

US 2010/0291799 A1 Nov. 18, 2010

(30) Foreign Application Priority Data

May 12, 2009 (TW) ..... 098208103

(51) Int. Cl.
*H01R 13/648* (2006.01)

(52) U.S. Cl. ..... 439/607.35

(58) Field of Classification Search ..... 439/79, 439/83, 607.01, 607.34, 607.23, 607.28, 439/607.35, 607.36, 607.39, 607.4
See application file for complete search history.

(56) References Cited

U.S. PATENT DOCUMENTS 7,578,701 B2 * 8/2009 Hsu ..... 439/607.34
2008/0038952 A1 * 2/2008 Hsu et al. ..... 439/312

FOREIGN PATENT DOCUMENTS

CN 201038503 Y 3/2008

* cited by examiner

*Primary Examiner*—Javaid Nasri
(74) *Attorney, Agent, or Firm*—Wei Te Chung; Andrew C. Cheng; Ming Chieh Chang

(57) ABSTRACT

A shielded connector (100) includes an insulative housing (1) having a base portion (11) and an engaging portion (12), a plurality of contacts (2) disposed in the housing (1), each of the contacts (2) defining a contacting portion (21) extending into the engaging portion (12) and a soldering portion (22) extending out of the housing (1), a metallic shell (3) having side walls surrounding the engaging portion (12) and a pair of positioning brackets (31) folding outwards from an upper edge of the side walls (303). The shielded connector furthermore defines a pair of insulative supporting sections (15) respectively disposed and supported under the positioning brackets (31) thereby forming a positioning device.

7 Claims, 8 Drawing Sheets

SHIELDED CONNECTOR WITH ENLARGED BASE SUPPORTING CANTILEVERED BRACKETS EXTENDING FROM THE SHIELDED CONNECTOR

BACKGROUND OF THE INVENTION

1. Field of the Invention

The present invention relates to a shielded connector, and more particularly to a shielded connector with an enlarged base on which the shielded connector stands on for readily mounting onto a printed circuit board (PCB).

2. Description of the Related Art

CN Pat. No. 201038503Y issued to Hu et. al on Mar. 19, 2008, discloses a HDMI connector vertically soldered onto a PCB. The connector includes an insulative housing, a plurality of contacts arranged in the insulative housing along a longitudinal direction and an inner shell shielding the insulative housing and an outer shell covering exterior of the inner shell. The outer shell has a pair of cantilevered brackets extending from a body wall of the outer shell. Each of the brackets defines a mounting ear horizontally joining to the body wall and a holding leg vertically folded downwards from an edge of the mounting ear. The holding legs are soldered with the PCB to provide two additional holding points for the connector steadily standing on the PCB. However, the brackets will sustain a bigger pressure and deformed, if the mounting ear is pressed downward when the mounting ears engage with a peripheral apparatus. Furthermore, the holding legs could destroy a protecting layer covering on electric traces of the PCB. So the shell could electrically connect with the uncovered electric traces of the PCB to interfere with original signal of the connector.

Therefore, an improved electrical connector is desired to overcome the disadvantages of the related arts.

SUMMARY OF THE INVENTION

An object of the present invention is to provide a shielded connector having insulative supporting sections to steadily support cantilevered brackets extending from the shielded connector for making the shielded connector readily mounting onto a PCB.

In order to achieve above-mentioned object, a shielded connector in accordance with a preferred embodiment of the present invention includes an insulative housing having a base portion and an engaging portion, a plurality of contacts disposed in the housing, each of said contacts defining a contacting portion extending into the engaging portion and a soldering portion extending out of the housing, a metallic shell having side walls surrounding the engaging portion and a pair of positioning brackets folding outwards from an upper edge of the side wall. The shielded connector furthermore defines a pair of insulative supporting sections respectively disposed and supported under the positioning brackets thereby forming a positioning device.

Other objects, advantages and novel features of the invention will become more apparent from the following detailed description of the present embodiment when taken in conjunction with the accompanying drawings.

DETAILED DESCRIPTION OF THE INVENTION

Figure 1:
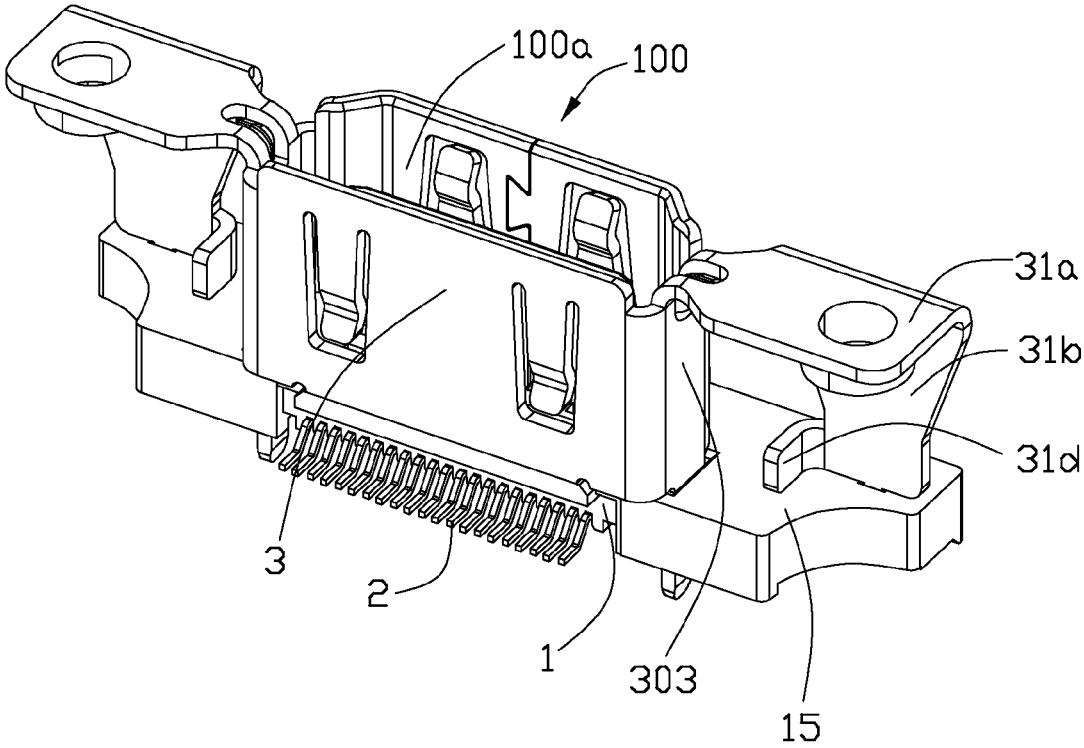
FIG. 1 is a perspective view of a shielded connector in accordance with one preferred embodiment of the present invention.

Reference will now be made to the drawing figures to describe the preferred embodiment of the present invention in detail.

Referring to FIGS. 1 to 4, a shielded connector 100 of a first preferred embodiment of the present invention is shown. The shielded connector 100 for being mounted on a PCB (not shown) includes an insulative housing 1, a plurality of contacts 2 arranged in two rows and disposed in the insulative housing 1, and a metallic shell 3 shielding the insulative housing 1.

Figure 2:
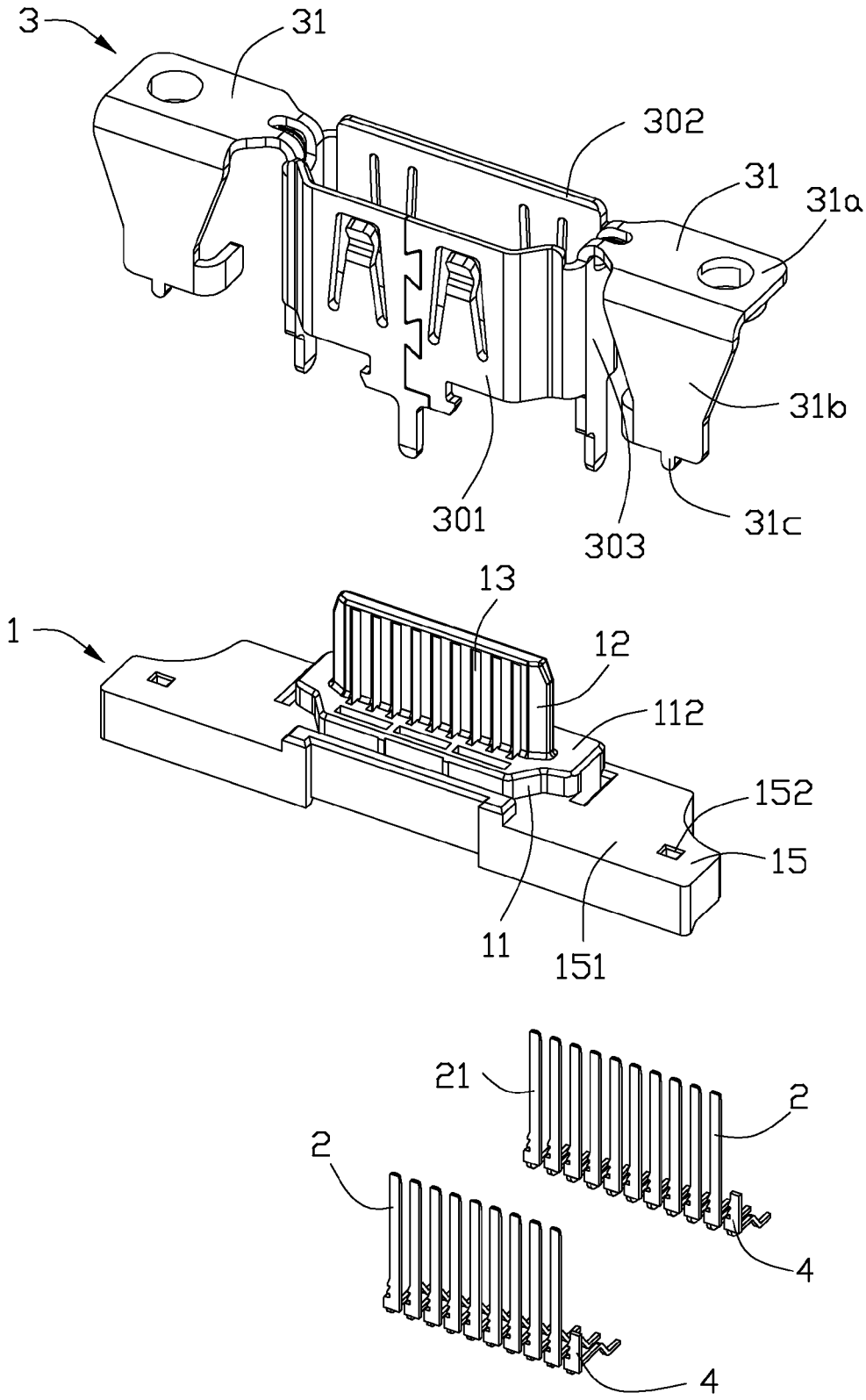
FIG. 2 is an exploded perspective view of FIG. 1.
Figure 3:
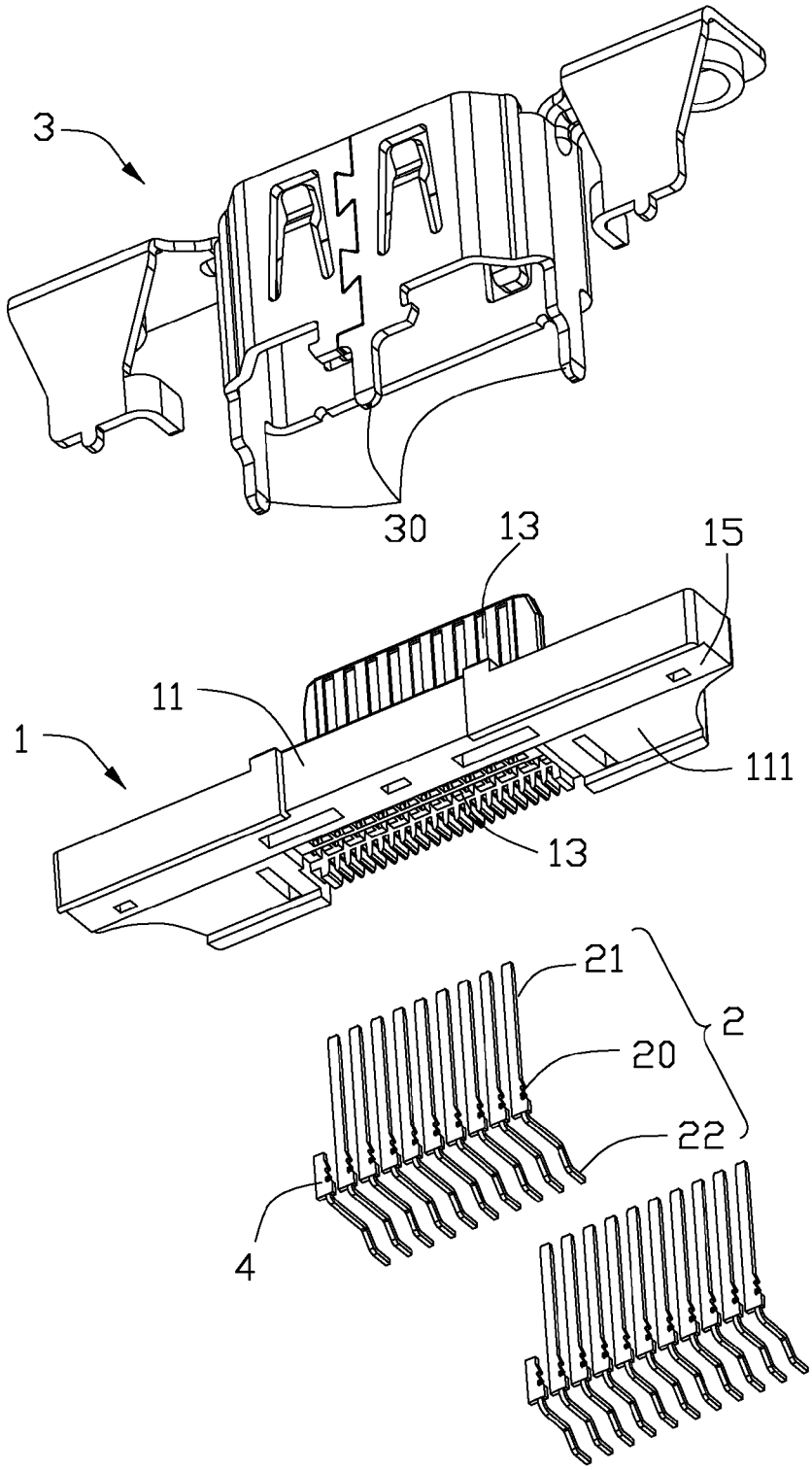
FIG. 3 is another perspective view of FIG. 2.

Referring to FIGS. 2 and 3, the insulative housing 1 has a base portion 11 and an engaging portion 12 protruding upwardly from the base portion 11 along a mating direction, i.e. a vertical direction. The base portion 11 defines a bottom mounting surface 111 and a top surface 112 opposite to the mounting surface 111. The engaging portion 12 extends from the top surface 101 and forms tongue-shaped configuration. The engaging portion 12 includes a plurality of grooves 13 respectively disposed at both sides thereof and extending through the mounting surface 111 for receiving the contacts 2. The grooves 13 are regarded as a contact receiving area. The contacts 2 are arranged in two rows in a longitudinal direction perpendicular to the mating direction.

Each of said contacts 2 defines a retaining portion 20 retained in the base portion 11, a contacting portion 21 extending upwards into the grooves 13 of the engaging portion 12 from one end of the retaining portion 20 for electrically connecting with a mating connector (not shown), a soldering portion 22 extending out of the base portion 11 for being soldered onto the PCB. The connector 100 includes at least one retaining attachment 4 similar to the contacts 2 but without the contacting portion 21. So the retaining attachment 4 is just retained in the base portion 11 and soldered on the PCB to provide a firm attachment force for the connector 100.

The metallic shell 3 surrounds the engaging portion 12 for providing a perfect shielding. Furthermore a bottom portion 30 of the metallic shell 3 is steadily retained in the base portion 11 and connects with a grounding trace of the PCB for EMI. The metallic shell 3 includes a first side wall 301, a second side wall 302 and a pair of third walls 303 connecting with the first side wall 301 and the second side wall 302. The engaging portion 12 is surrounded by said side walls of the metallic shell 3, thereby forming a mating room 100*a* for receiving the mating connector therein. The metallic shell 3 also has a pair of cantilevered positioning brackets 31 folding outwards from an upper edge of the third side walls 303. The positioning bracket 31 includes a mounting ear 31*a* which horizontally and integrally connecting with the third side wall 303 for mechanically engaging with a peripheral apparatus (not shown) and a holding leg 31*b* vertically folded downwards from an edge of the mounting ear 31*a*.

Figure 4:
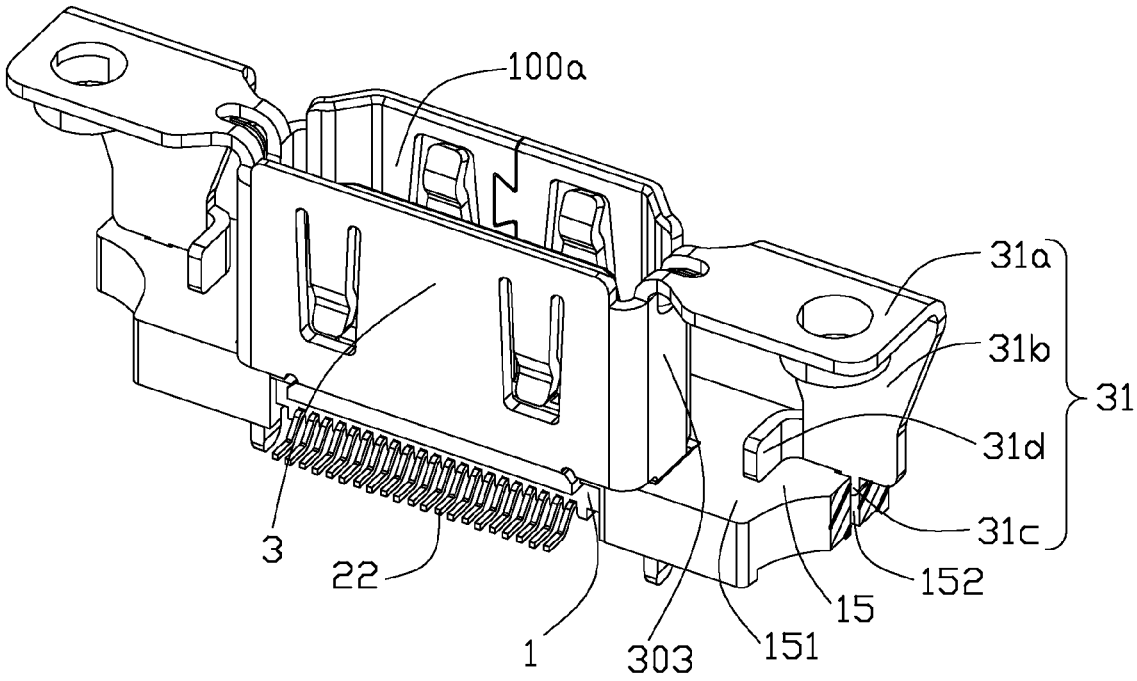
FIG. 4 is a partial cross-section view of the insulative housing of FIG. 1 and showing a positioning tail of a metallic shell received in the insulative housing.

Referring to FIGS. 2 and 4, the base portion 11 of the insulative housing 1 defines a pair of insulative supporting sections 15 disposed under the positioning brackets 31 thereby forming a positioning device for making the connector 100 readily and steadily mounting onto a PCB. So the insulative supporting sections 15 are regarded as a supporting area for holding said positioning brackets 31. The insulative supporting sections 15 integrally extend outwards from both side of the base portion 11 along the longitudinal direction. Each of the positioning brackets 31 has a positioning tail 31*c* protruding downwards from an end of the holding leg 31*b* for being readily received into the insulative supporting section 15 and a supporting tab 31*d* extending from a side edge of the holding leg 31*b* for steadily pressing against on an upper surface 151 of the insulative supporting section 15. The positioning tail 31*c* is received and retained in the insulative supporting section 15, i.e. is hidden in a positioning hole 152 the insulative supporting section 15 at the mating direction. So that the positioning tails 31*c* doesn't extending through the insulative supporting section 15 and disengaged with the PCB for protecting the positioning brackets 31 from electrically connecting with the PCB and preventing positioning brackets 31 from interfering with original signal of the connector.

Referring FIG. 5 to FIG. 8, a shielded connector 600 of a second embodiment of the present invention is shown, which is similar to that of aforementioned connector except a described positioning device formed by a positioning bracket 81 of a shell 8 and a pair of insulative supporting sections 9 supported below the positioning bracket 81 and located on the PCB.

Figure 5:
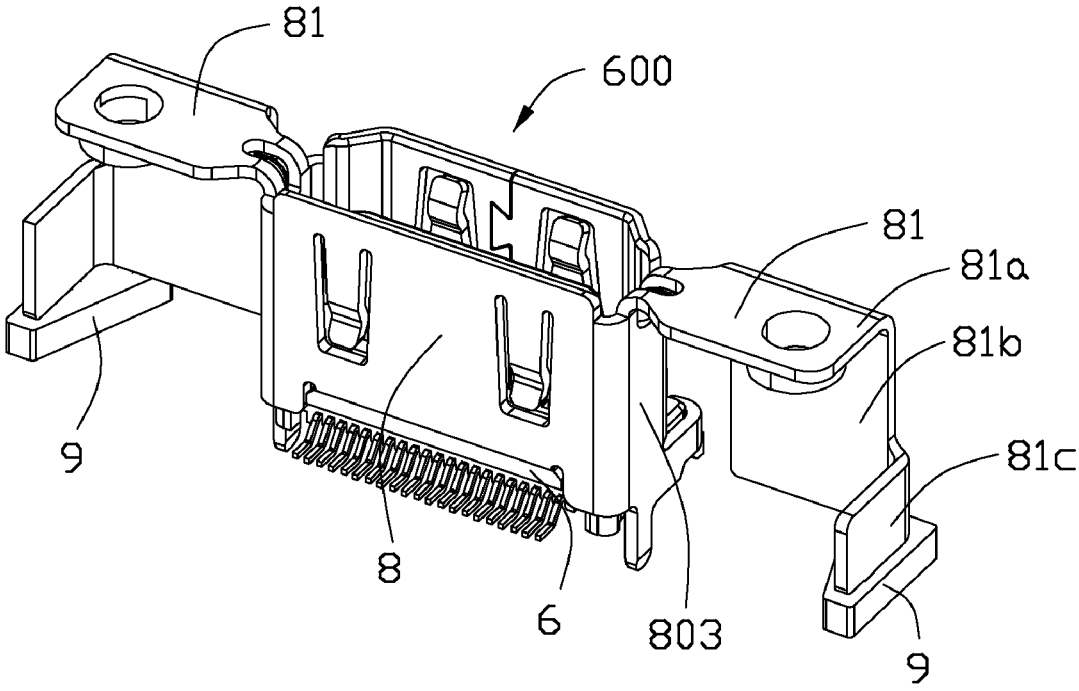
FIG. 5 is a perspective view of a shielded connector in accordance with another preferred embodiment of the present invention.
Figure 6:
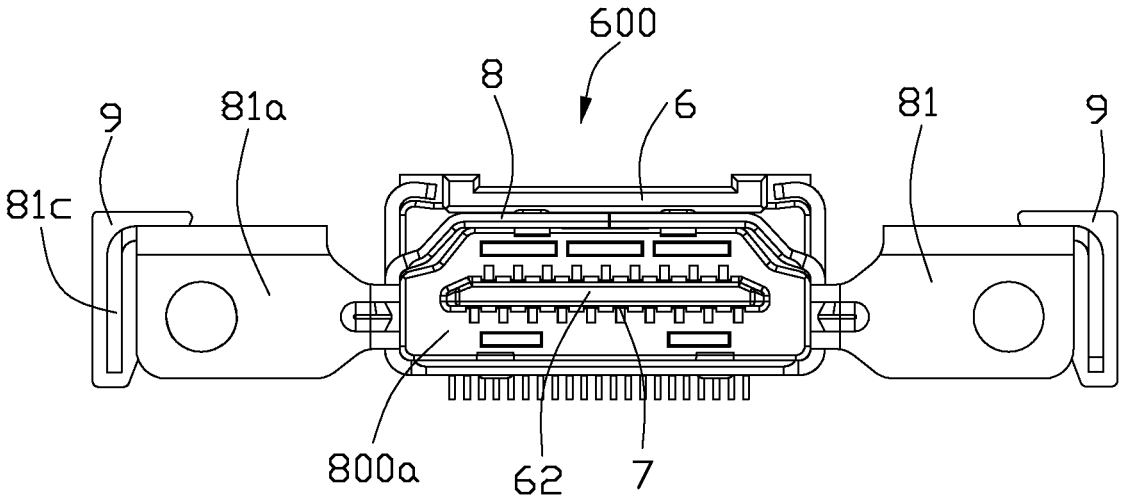
FIG. 6 is a top plan view of FIG. 5.
Figure 7:
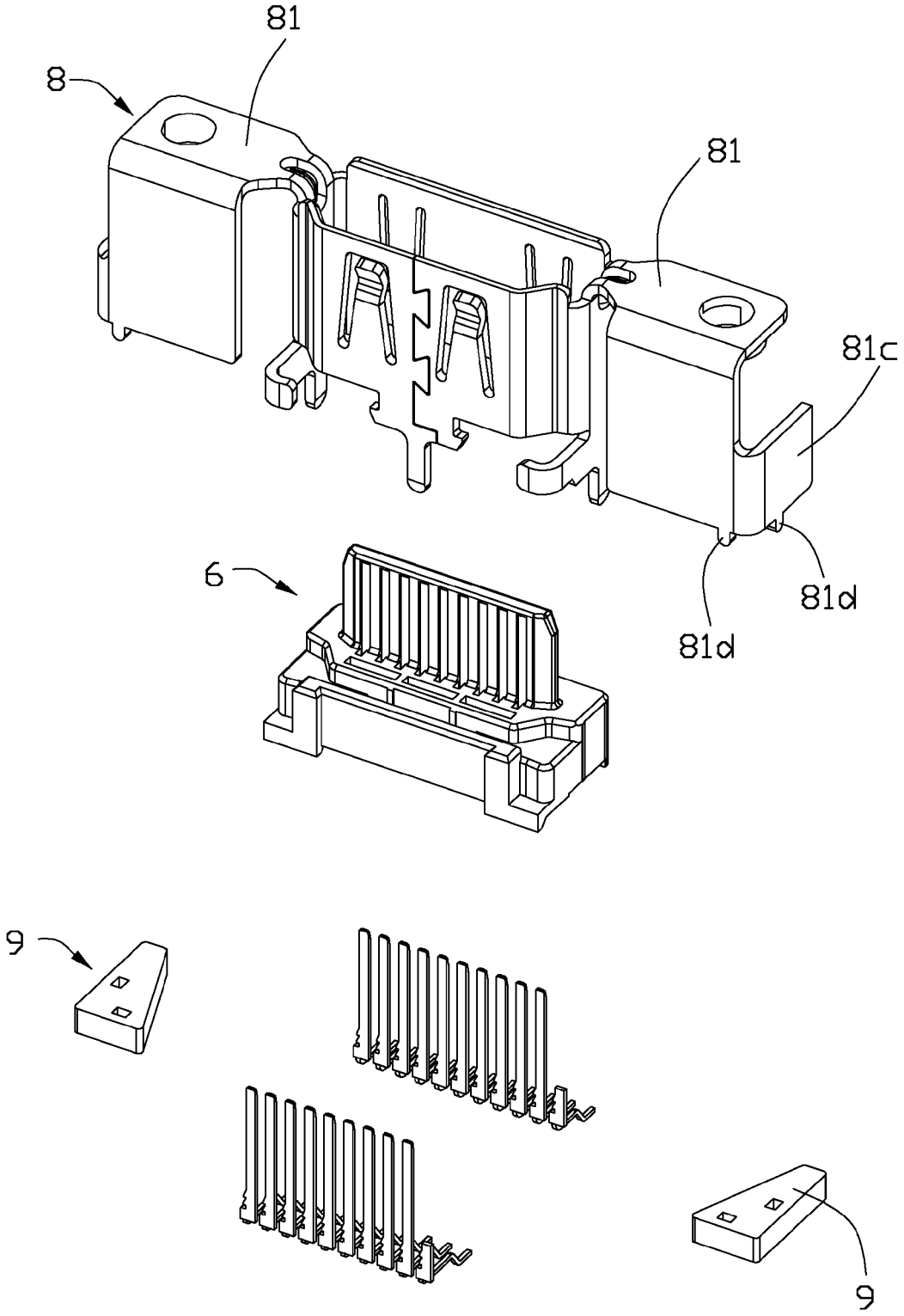
FIG. 7 is an exploded perspective view of FIG. 5.
Figure 8:
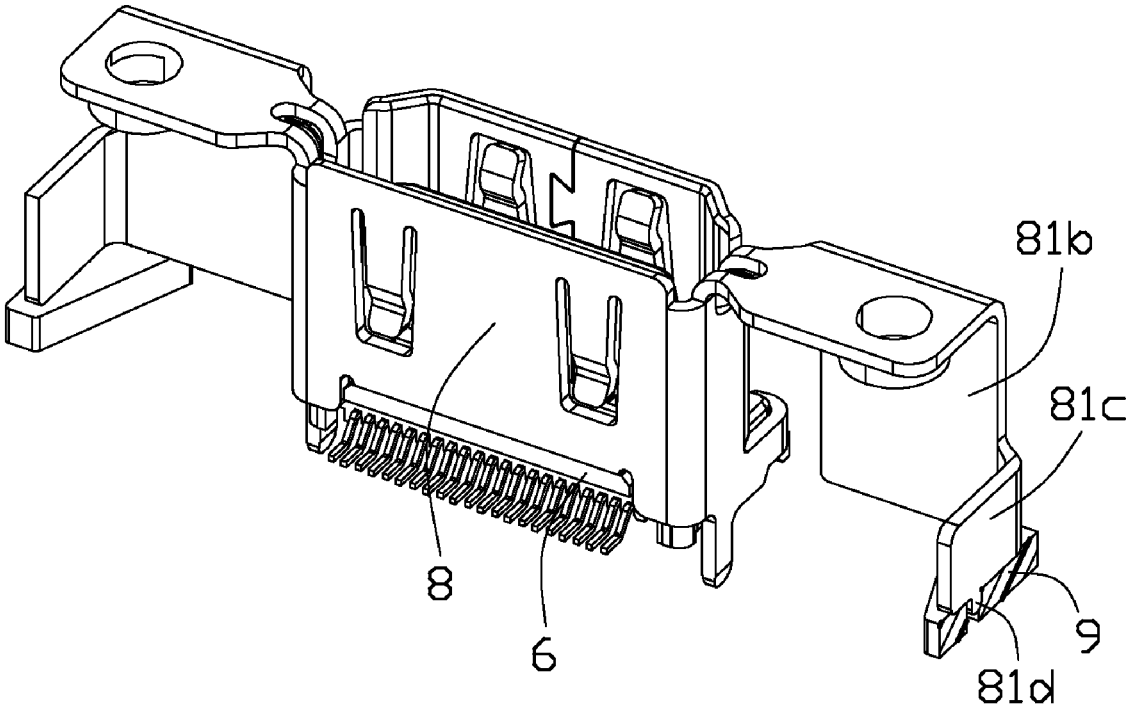
FIG. 8 is a partial cross-section view of FIG. 5 and showing a positioning tail of a metallic shell received in the insulative housing.

Referring to FIGS. 5 to 7, a pair of insulative supporting sections 9 are independently located both sides of an insulative housing 6 as a side by side manner along the longitudinal direction, i.e. the insulative supporting sections 9 are disengaged with an insulative housing 6 for easily being designed and manufactured. The positioning bracket 81 has a mounting ear 81*a* integrally connecting with one side wall 803 of the shell 8 for mechanically engaging with the peripheral apparatus and a holding leg 81*b* vertically folded downwards from an edge of the mounting ear 81*a*. Each of the positioning brackets 81 has a supporting tab 81*c* extending from the holding leg 81*b* for steadily pressing against on the insulative supporting section 9 and a positioning tail 81*d* extending from an edge of the supporting tab 81*c* for being easily positioned in the insulative supporting section 9. The positioning tails 81*d* also disengage with the PCB for preventing the positioning brackets 81 from interfering with original signal of the connector (as best seen from FIG. 8).

Referring to FIG. 6, the shielded connector 600 is a HDMI connector. The shell 8 surrounds the engaging portion 62 of the insulative housing 6 thereby forming a mating room 800*a*. The contacts 7 are arranged in two rows along the longitudinal direction and disposed on the engaging portion 62 to face to the mating room 800*a* for electrically engaging with the mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A shielded connector comprising: an insulative housing comprising a base portion and an engaging portion protruding upwardly from the base portion along a mating direction;

a plurality of contacts disposed in the housing, each of said contacts defining a contacting portion extending into the engaging portion of the housing and a soldering portion extending out of the housing;

a metallic shell comprising at least two side walls surrounding the engaging portion thereby forming a mating room for engaging a mating connector and a pair of positioning brackets folding outwards from an upper edge of each of the side walls; and wherein the shielded connector furthermore comprises a pair of insulative supporting sections respectively disposed and supported under the positioning brackets thereby forming a positioning device; wherein each of the positioning brackets comprises a holding leg and a positioning tail which is received and retained in the corresponding insulative supporting section at the mating direction; wherein the insulative supporting sections integrally extend outwards from the insulative housing, or are independently located by both sides of the insulative housing as a side by side manner along a longitudinal direction perpendicular to the mating direction; wherein each of the positioning brackets further comprises a supporting tab pressing against on an upper surface of the insulative supporting section, and each of the positioning tails protrudes from either the corresponding holding leg or the corresponding supporting tab; wherein each of the insulative supporting sections comprises a positioning hole for receiving the positioning tail therein.

2. The shielded connector as described in claim 1, wherein the engaging portion comprises a plurality of grooves extending through a mounting surface formed by the base portion of the insulative housing for receiving the contacting portions of the contacts.

3. The shielded connector as described in claim 2 further comprises a retaining attachment similar to the contact but without the contacting portion and retained in the base portion.

4. A shielded connector for mounting to a printed circuit board, comprising:

an insulative housing defining an upward mating port;

a plurality of contacts disposed in the housing with contacting sections exposed in the mating port;

a metallic shell defining a frame structure enclosing the mating port, a pair of positioning brackets extending from two opposite ends of the frame structure, each of said brackets including a horizontal mounting ear having a screw hole therein and located at an upper level approximate an entrance opening of said mating port, a vertical holding legs downwardly extending from the mounting ear with a distance essentially similar to a height of the connector; wherein a bottom edge of each leg is supported by an insulator at a lower level near a bottom face of the housing for not touching the printed circuit board on which said connector is mounted; wherein said insulator is spaced from the housing for leaving a space in alignment with the corresponding screw hole in a vertical direction, or said insulator is unitarily formed with the housing while defining a recess in alignment with the corresponding screw hole in a vertical direction.

5. The shielded connector as claimed in claim 4, wherein the holding leg extending in a first plane, is equipped with a supporting tab extending in a second plane and also supported by the insulator.

6. The shielded connector as claimed in claim 5, wherein said second plane is perpendicular to said first plane.

7. The shielded connector as claimed in claim 4, wherein the frame structure and the housing have respect means for mounting to the printed circuit board.

* * * * *